US011572745B2

(12) United States Patent
Hogan

(10) Patent No.: US 11,572,745 B2
(45) Date of Patent: Feb. 7, 2023

(54) RIGID RISER ADAPTER FOR OFFSHORE RETROFITTING OF VESSEL WITH FLEXIBLE RISER BALCONIES

(71) Applicant: OIL STATES INDUSTRIES, INC., Arlington, TX (US)

(72) Inventor: Michael Eugene Hogan, Arlington, TX (US)

(73) Assignee: Oil States Industries, Inc., Arlington, TX (US)

( * ) Notice: Subject to any disclaimer, the term of this patent is extended or adjusted under 35 U.S.C. 154(b) by 183 days.

(21) Appl. No.: 17/223,503

(22) Filed: Apr. 6, 2021

(65) Prior Publication Data

US 2021/0317709 A1 Oct. 14, 2021

Related U.S. Application Data

(60) Provisional application No. 63/007,072, filed on Apr. 8, 2020.

(51) Int. Cl.
*E21B 19/00* (2006.01)

(52) U.S. Cl.
CPC ..... *E21B 19/004* (2013.01)

(58) Field of Classification Search
CPC ..... E21B 17/01; E21B 17/085; E21B 19/004; E21B 43/0107; B63B 27/24; B63B 27/34
See application file for complete search history.

(56) References Cited

U.S. PATENT DOCUMENTS

| | | | | |
|---|---|---|---|---|
| 5,269,629 | A * | 12/1993 | Langner | E21B 19/004 405/195.1 |
| 5,615,977 | A * | 4/1997 | Moses | E21B 17/015 405/195.1 |
| 5,639,187 | A * | 6/1997 | Mungall | E21B 43/017 405/195.1 |
| 5,905,212 | A * | 5/1999 | Moses | F16F 1/393 73/862.043 |
| 6,739,804 | B1 * | 5/2004 | Haun | E21B 19/004 405/195.1 |
| 7,572,085 | B2 * | 8/2009 | Luppi | E21B 17/015 405/158 |
| 7,914,234 | B2 * | 3/2011 | Large | B63B 21/502 405/224.2 |
| 8,550,171 | B2 * | 10/2013 | Wajnikonis | E21B 17/015 166/359 |
| 9,988,860 | B2 * | 6/2018 | Salem | E21B 17/085 |
| 10,330,230 | B2 * | 6/2019 | Capllonch | F16L 23/02 |
| 2011/0277845 | A1 * | 11/2011 | Le Devehat | B63B 27/24 137/234.6 |
| 2017/0350196 | A1 * | 12/2017 | Hoyvik | E21B 43/0107 |
| 2017/0356255 | A1 * | 12/2017 | Spears | E21B 19/004 |

(Continued)

*Primary Examiner* — Benjamin F Fiorello
(74) *Attorney, Agent, or Firm* — Polsinelli PC

(57) ABSTRACT

Rigid riser adapter operable to be at least partially installed into a lower riser balcony. The rigid riser adapter includes a receptacle support structure. Additionally, the rigid riser adapter also includes an adapter tube extending from the receptacle support structure substantially along a vertical direction, the adapter tube operable to be inserted through a lower riser balcony. The rigid riser adapter can also include a rigid riser receptacle coupled to the receptacle support structure, wherein the rigid riser receptacle is angled between six degrees and twenty degrees in relation to the vertical direction.

23 Claims, 7 Drawing Sheets

(56) References Cited

U.S. PATENT DOCUMENTS

| | | | | |
|---|---|---|---|---|
| 2018/0155994 | A1* | 6/2018 | Wajnikonis | E21B 19/004 |
| 2019/0032428 | A1* | 1/2019 | Askestad | E21B 17/05 |
| 2021/0348455 | A1* | 11/2021 | Amorim | E21B 17/01 |

* cited by examiner

RIGID RISER ADAPTER FOR OFFSHORE RETROFITTING OF VESSEL WITH FLEXIBLE RISER BALCONIES

CROSS-REFERENCE TO RELATED APPLICATIONS

The present application claims the benefit of U.S. Provisional Application No. 63/007,072, filed Apr. 8, 2020, which is hereby incorporated by reference in its entirety.

FIELD

The present disclosure relates generally to apparatuses, systems, and methods to retrofit vessels designed to use flexible risers to accommodate the use of rigid risers.

BACKGROUND

In order to produce oil or gas, a well is drilled into a subterranean formation, which may contain a hydrocarbon reservoir or may be adjacent to a reservoir. In offshore environments, flexible risers are constructed using multiple layers that can include one or more of a carcass, internal sheath, pressure armor, tensile armor, and/or an external sheath. The flexible risers are tied back to floating production vessels that can be moored in water depths that typically 1000 meters or deeper. The floating production vessels are configured for a particular type of riser, such as a flexible riser. The floating production vessels that are configured for flexible risers implement an upper riser balcony/porch that is above the water line and a lower riser balcony/porch that is below the water line. The flexible riser is pulled through the lower riser balcony and attached to the upper balcony.

BRIEF DESCRIPTION OF THE DRAWINGS

Implementations of the present technology will now be described, by way of example only, with reference to the attached figures, wherein.

DETAILED DESCRIPTION

Figure 1:
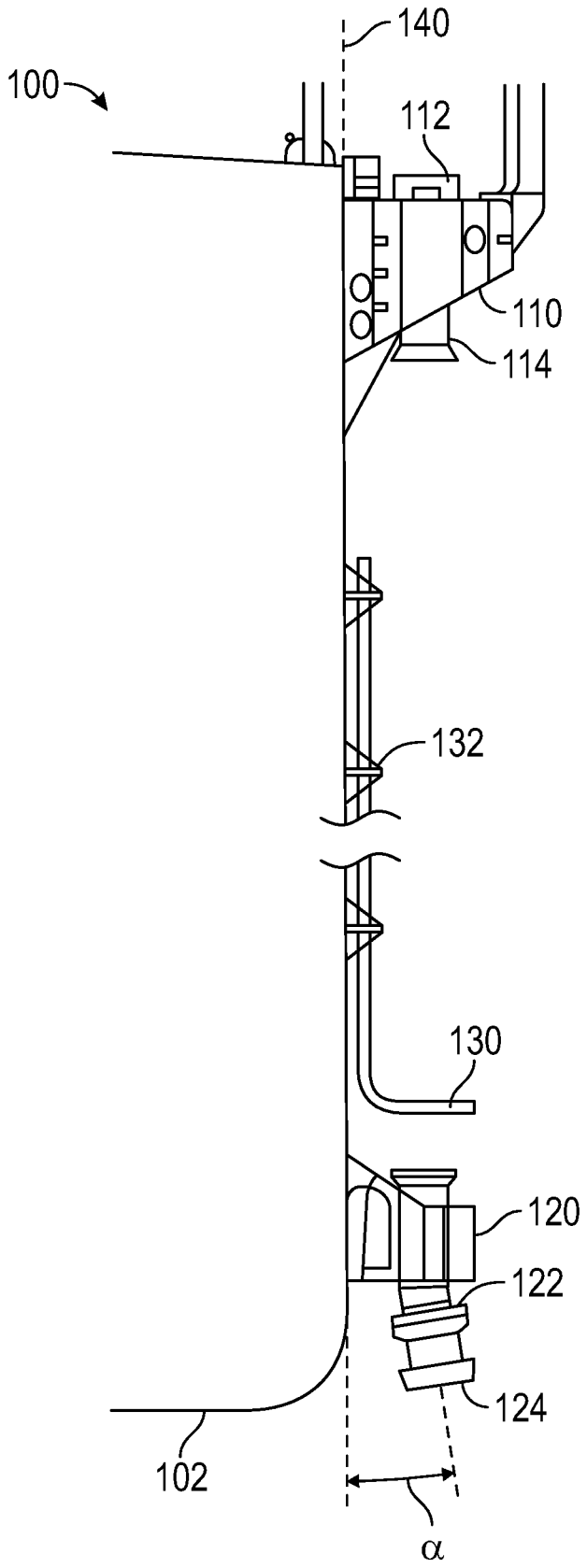
FIG. 1 is a diagram illustrating an example of a vessel having an upper riser balcony and lower riser balcony.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented. The term "coupled" is defined as connected, whether directly or indirectly through intervening components, and is not necessarily limited to physical connections. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "about" means reasonably close to the particular value. For example, about does not require the exact measurement specified and can be reasonably close. As used herein, the word "about" can include the exact number. The term "near" as used herein is within a short distance from the particular mentioned object. The term "near" can include abutting as well as relatively small distance beyond abutting. The terms "comprising," "including" and "having" are used interchangeably in this disclosure. The terms "comprising," "including" and "having" mean to include, but not necessarily be limited to the things so described.

Disclosed herein is a rigid riser adapter and a method related to the installation of the rigid riser adapter into a lower riser balcony. The lower riser balcony is affixed to a vessel. In at least one example, the vessel is a floating production vessel. In other examples, the vessel can be a production platform, production ship, or any vessel that includes an upper riser balcony and a lower riser balcony configured to accommodate flexible risers. The rigid riser adapter as presented herein allows a vessel that is configured to be used with flexible risers to be retrofit to accommodate rigid risers. The design as presented herein takes into account the difficulties in doing a retrofit. Specifically, the present design does not require underwater welds because it may not be possible or convenient to provide certifiable full penetration welds to a vessel hull underwater.

Production fluid from existing offshore wells can be imported to a floating production vessel via unbonded flexible riser pipe. In at least one example, unbonded flexible riser pipe is constructed using a polymeric internal sheath that is relatively impermeable to hydrocarbons with a chemically non-polar molecular structure (for example, alkanes), but relatively permeable to fluids with a polar molecular structure (for example, water, carbon dioxide, and hydrogen sulfide). The internal sheath can be reinforced along its inner surface by a metallic carcass assembly that help prevent kinking or buckling of the internal sheath. The construction of the metallic carcass has limited mechanical strength and is permeable by liquids and gases. The outer surface of the unbonded flexible riser pipe is comprised of a polymeric external sheath that is relatively impermeable to sea water. The annular spaces between the internal sheath and the external sheath of the flexible riser includes several layers of high-strength carbon steel, each with different mechanical functions. A helically coiled layer of high-strength carbon steel, with a relatively short winding pitch, surrounds the inner polymeric liner in order to provide hoop reinforcement of the polymeric liner, which is subject to hydraulic pressure from the flowline fluid. This layer is the pressure armor. Additional layers of high-strength carbon steel are arranged about the outer surface of the pressure armor. These layers are comprised of bands of carbon steel wrapped at a longer winding pitch in order to support the weight of the riser. These layers are known as tensile armor.

If the continuity of the tensile armor is compromised, the flexible riser pipe cannot support its own weight, leading to a parting of the riser, rendering it incapable of continued production service, and potentially leading to release of hydrocarbons into the ocean environment, and to possible injury or death of offshore personnel.

When the risers are operating in production mode, they convey high-pressure volumes of the hydrocarbon and carbon dioxide mixture to the production vessel for processing and separation. When the riser are operating in gas injection mode, they convey high pressure volumes of gas, often consisting of a high concentration of carbon dioxide, back into the well.

Over time, carbon dioxide diffuses from the bore of the riser outward through the carcass and internal sheath into the annulus volume occupied by the carbon steel armor layers. Water diffuses slowly inward through the external sheath into the armor layers. Under pressure, the carbon dioxide dissolves into the water and evolves as carbonic acid, which acts to corrode the high-strength steel material. Under the high tension caused by the extreme weight of the long flexible riser, the mechanical stress in the steel armor is increased, providing additional energy that accelerates the corrosion.

The majority of flexible risers have been installed for deep water service for reservoirs with high carbon dioxide content have been operating for less than eight years. Several flexible risers have failed in service in the past two years. Various means have been used to attempt to detect the onset of failure due to corrosion in the tensile armor, but the effectiveness of these have been complicated by the fact that the corrosion is occurring in an annular space that is hidden by the external sheath. As a result, there are many deep water risers that are at risk of sudden failure. One solution would be to replace the existing flexible risers every three to five years. Replacing the flexible risers on this basis would be at great cost.

A permanent solution to this problem would be to replace the existing flexible riser with rigid steel risers. Such rigid risers are typically lined internally with Inconel and have been operating successfully in deep water, high carbon dioxide wells for years. Replacement of the at-risk flexible riser with rigid risers of this type would increase the expected operating life to more than thirty years.

Replacing the existing flexible riser with rigid riser is conventionally not possible with vessels designed for flexible risers as the vessels do not have an appropriate point of connection for rigid risers. Rigid risers need to be connected with an initial departure angle from vertical of between ten and fifteen degrees. The end joint of a rigid riser is either an elastomeric flexible joint, or a stress joint with gradually increasing wall thickness. Both joint types require a special receptacle. The ideal location for hanging off such end joints is below the water line, closer to the keel elevation of the vessel. Existing vessels have not been equipped with this type of receptacle.

The receptacle arrangement that exists on these vessels includes an upper riser balcony and a lower riser balcony. The upper riser balcony is above the water line, near deck level, and has been designed to withstand the full dynamic weight of the riser. The lower riser balcony is attached to the hull below the water line. The lower riser balcony is designed to withstand the dynamic moment, but not the full dynamic tension, of the flexible riser. There are openings that pass vertically through the upper and lower balconies. The openings are arranged so that the flexible riser can be installed by pulling the end of the flexible riser up through the lower riser balcony, and then through the upper riser balcony so that the end of the flexible riser can be attached to the upper riser balcony.

For reasons associated with optimizing the fatigue life of the two types of riser, flexible risers are attached to vessels with a mean hang-off angle from vertical of approximately 5 degrees, but for rigid risers, this mean hang-off angle typically must be between six and twenty degrees. In the upper and lower riser balcony arrangement, the mean angle for the flexible riser is accommodated at the lower opening of the lower riser balcony by means of a short, bolted adapter tube or I-tube. However, if the tube were to be replaced with an adapter tube providing a six to twenty degree bend, the available space (or drift) for a pipe or structural member to pass through both the upper and lower balconies could be reduced to such an extent that connection of a rigid riser below the lower porch would become impossible.

Conventionally, the connection structure for a rigid riser was to design and fabricate a steel structure that is welded to the hull of a vessel or a balcony on the vessel while the vessel was in the shipyard. This was done to provide specific angles of departure for the rigid riser from vertical and relative to the beam of the hull of the vessel. However, as indicated above, it is not possible to provide certifiable structural welds underwater. The present disclosure uses the existing structural features of the vessel designed for flexible risers to provide attachment points with the necessary structural integrity for the rigid riser adapter disclosed herein.

The disclosure now turns to FIG. 1, which illustrates a diagrammatic view of an example of vessel 100 that is operable for use with flexible risers. The vessel 100 includes an upper riser balcony 110 and a lower riser balcony 120. The upper riser balcony 110 is operable to be located above the water line when the vessel 100 is disposed in the water. The lower riser balcony 120 is operable to be located below the water line when the vessel 100 is in the water. In at least one example the lower riser balcony 120 is near the keel elevation 102 of the vessel 100 towards the direction of the upper riser balcony 110. In at least one example, the lower riser balcony 120 is about twelve meters below the upper riser balcony 110. However, there are similar vessels which have greater or lesser vertical separation of the upper and lower porch. There also may be vessels with lesser vertical separation. The actual distance depends on the size, storage capacity, and mooring requirements for a particular vessel.

The upper riser balcony 110 includes a hang-off 112 and an upper I-tube 114. The upper I-tube 114 can be operable to extend through the upper riser balcony 110 in the vertical direction. The lower riser balcony 120 includes a lower I-tube 122 and a bellmouth 124 extending from the bottom of the lower I-tube 122. The lower I-tube 122 can be operable to extend through the lower riser balcony 120 in the vertical direction. The upper I-tube 114 and lower I-tube can be substantially aligned in a vertical direction 140. The vessel 100 also includes features to which a hard pipe 130 may be attached to the vessel 100 by hard pipe supports 132. This hard pipe 130 would be used to connect the riser to the processing facilities aboard the production vessel in the event that a rigid riser is installed.

In the illustrated example, the vessel 100 is operable for use with flexible risers (not illustrated). In at least one example, the upper riser balcony 110 and the hang-off 112 are operable to withstand the fully dynamic weight of the flexible riser. The lower riser balcony 120 is operable to withstand the dynamic moment of a flexible riser, but not the full dynamic weight of the flexible riser. In order to install the flexible riser to the vessel 100, the flexible riser is pulled from below the lower riser balcony 120 through the bell-mouth 124 and up through lower I-tube 122. The flexible riser is further pulled up towards the upper riser balcony 110 and through the upper I-tube 114. The flexible riser is installed in the hang-off 112. The flexible riser is configured to have a mean hang-off angle α from vertical 140 of approximately five degrees. The rigid riser adapter as presented herein is operable to allow the rigid riser to be hung from the lower riser balcony 120 conventionally configured for a flexible riser using the rigid riser adapter.

Figure 2:
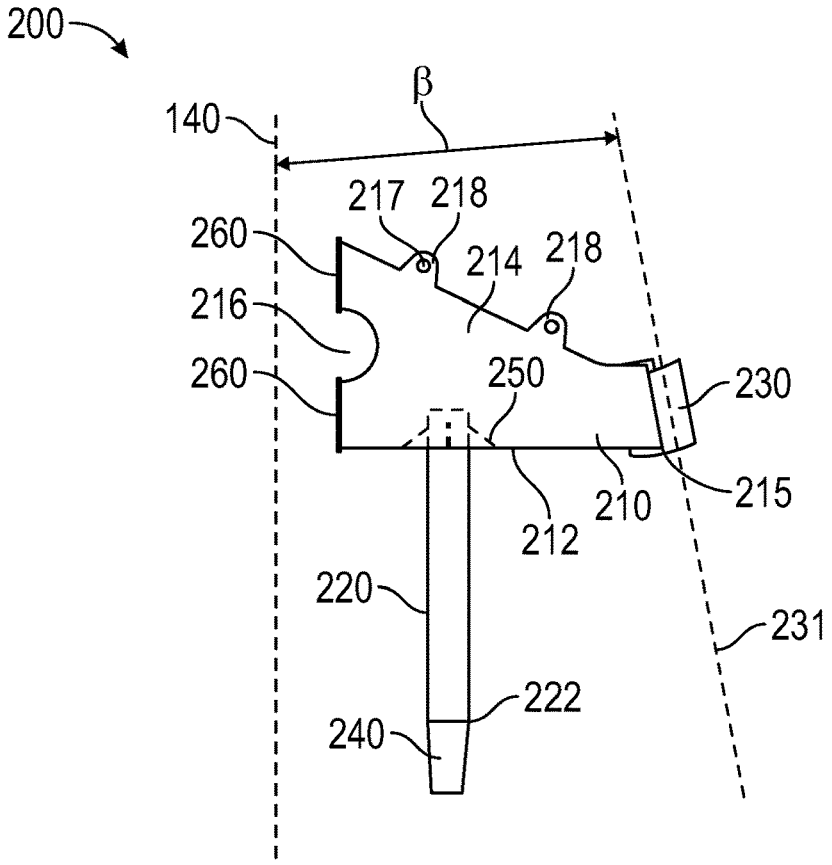
FIG. 2 illustrates a side view of an example of a rigid riser adapter.

The present disclosure presents a rigid riser adapter 200 in FIGS. 2-5. FIG. 2 illustrates a side view of an example of a rigid riser adapter 200. The rigid riser adapter 200 is operable to be at least partially installed into a lower riser balcony such as the one illustrated in FIG. 1. The rigid riser adapter 200 is not limited for use with only the example lower riser balcony illustrated in FIG. 1 and can be operable to be implemented with other types of lower riser balconies. As illustrated in FIG. 2, the rigid riser adapter 200 includes a receptacle support structure 210. The rigid riser adapter 200 includes an adapter tube 220 extending from the receptacle support structure 210.

The receptacle support structure 210 can include a floor 212 through which the adapter tube 220 extends. In other examples, the adapter tube 220 can be coupled to the outer side of the floor 212 without passing therethrough. Additionally, at least one attachment plate 250 can be coupled to the floor 212 and the adapter tube 220. The at least one attachment plate 250 can secure the adapter tube 220 with the floor 212 of the receptacle support structure 210. For example, the at least one attachment plate 250 can prevent undesired movement of the adapter tube 220 in relation to the receptacle support structure 210. In at least one example where the adapter tube 220 passes through the floor 212, the at least one attachment plate 250 can be located within an interior of the receptacle support structure 210. In other examples, the at least one attachment plate 250 can be located on an exterior of the floor 212. As illustrated, the at least one attachment plate 250 comprises a plurality of attachment plates 250. In at least one example, the number of attachment plates 250 can be four. In at least one example, the plurality of attachment plates 250 can be substantially triangular shaped. In other examples, the plurality of attachment plates 250 can take other shapes. The use of the triangular shape allows for contact along both the floor 212 and the adapter tube 220 thereby increasing the strength, while saving weight and space with the shape of a triangle.

The receptacle support structure 210 can also include at least one side 214. In at least one example, the receptacle support structure 210 can include a plurality of sides 214. As illustrated, the plurality of sides 214 can number two. The plurality of sides 214 can extend from the floor 212. In at least one example, the plurality of sides 214 can be substantially perpendicular to the floor 212. In at least one example, a plurality of tabs 218 can be formed on each of the plurality of sides 214. The plurality of tabs 218 are disposed along the plurality of sides 214 to allow for weight distribution when the rigid riser adapter 200 is lifted and maneuvered. The plurality of tabs 218 can be configured with eyelets 217 that allow for shackles or other equipment to be fastened thereto or pass therethrough. In at least one example, the plurality of tabs 218 can number two tabs per side 214. In this configuration, the spacing of the two tabs 218 can be such that the tabs provide for easier maneuvering with a center of gravity for the rigid riser adapter 200.

The adapter tube 220 extends substantially along a vertical direction 140 from the receptacle support structure 210. The adapter tube 220 is operable to be inserted through a lower riser balcony 120. The adapter tube 220 can be configured to fit in the respective lower riser balcony 120. For example, as illustrated, the adapter tube 220 can have a diameter or width of approximately one meter. The diameter can be changed to match the respective diameter of lower I-tube, which can be sized for a particular flexible riser pipe diameter.

The adapter tube 220 can have a distal end 222 that is coupled to a frustoconically shaped insertion tube 240. The distal end 222 is away from the receptacle support structure 210. In some examples, the insertion tube 240 and the adapter tube 220 can be a singular element. The insertion tube 240 is shown as being substantially frustoconically shaped to allow for easier alignment and insertion of the adapter tube 220 into the lower riser balcony as will be further explained below. As illustrated the adapter tube 220 can be substantially cylindrical or a rectangular prism. In other examples, the adapter tube 220 can be frustoconically shaped, or any geometric surface that will provide a plurality of reactive points of contact with the inner surface of the adapter tube 220.

The rigid riser adapter 200 can include a rigid riser receptacle 230 coupled to the receptacle support structure 210. The rigid riser receptacle 230 can be operable to receive a rigid riser end joint (not illustrated). The rigid riser receptacle 230 can be angled (illustrated by line 231, which passes through a centreline of the rigid riser receptacle 230) at angle θ with respect to the vertical direction 140. The vertical direction as illustrated corresponds substantially to the direction of a gravity vector when the vessel is stationary. The angle θ can be between about six degrees and about twenty degrees in relation to the vertical direction 140. In at least another example, the angle θ can be between about ten degrees and about fifteen degrees in relation to the vertical direction 140. The actual value of angle θ depends upon the water depth, the riser weight, and the design tension that results in the longest fatigue life for the rigid riser near its touch-down point on the sea floor.

Figure 3:
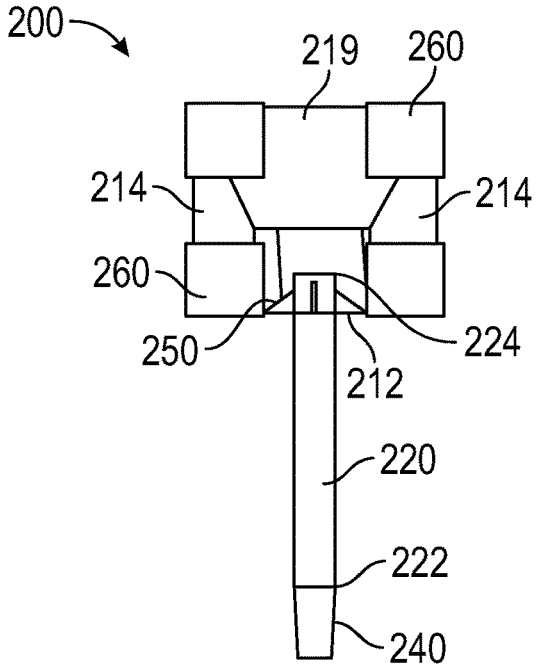
FIG. 3 illustrates a rear view of an example of a rigid riser adapter.
Figure 4:
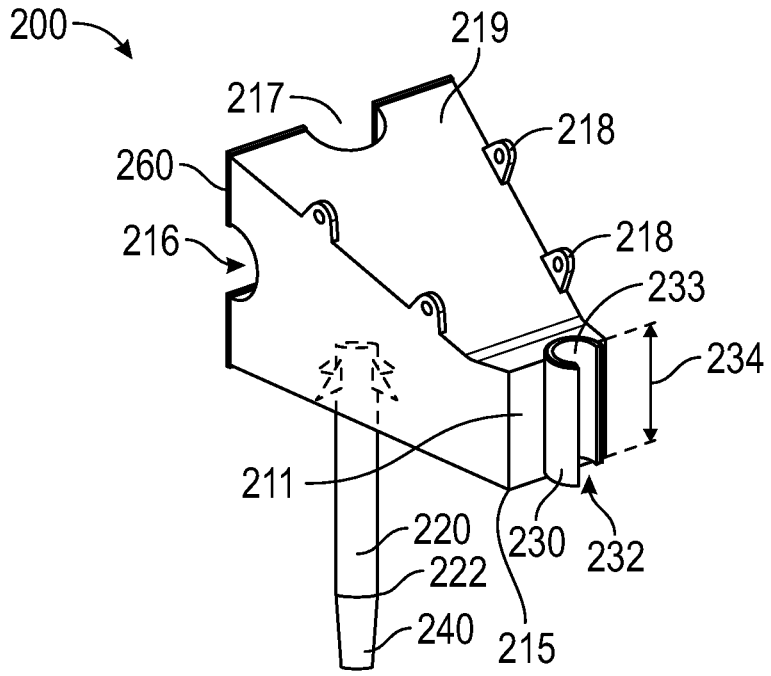
FIG. 4 illustrates an isometric view of an example of a rigid riser adapter.

FIG. 3 illustrates a rear view of an example of the rigid riser adapter 200. The receptacle support structure 210 can also include a plurality of pads 260 that are coupled to at least one of the plurality of sides 214. The plurality of pads 260 are operable to abut against the vessel 100 when the rigid riser adapter 200 is installed in the lower riser balcony 120. When the vessel 100 and the rigid riser adapter 200 move relative to one another, the plurality of pads 260 can distribute force between the rigid riser adapter 200 and the vessel 100 to prevent damage to the vessel 100 and/or the rigid riser adapter 200. The surface of the pads 260 may be coated with thermally sprayed aluminium in order to prevent crevice corrosion when the pads 260 are placed in contact with the surface of the hull of the vessel 100. As illustrated in FIGS. 2 and 4, each of the plurality sides 214 can form a substantially semi-circular cutout 216 between two of the plurality of pads 260. The substantially semi-circular cutout 216 assists in distributing force between the pads 260 and the receptacle support structure 210.

FIG. 4 illustrates an isometric view of an example of the rigid riser adapter 200. In at least one example, the receptacle support structure 210 can also include a top plate 219 that is coupled to the plurality of sides 214 and being substantially opposite the floor. As illustrated the top plate 219 need not be parallel to the floor 212. In at least one example, the top plate 219 can have a portion that is sloped relative to the floor 212. Additionally, the top plate 219 can have another portion that is substantially parallel to the floor 212.

As illustrated in FIG. 3 and FIG. 4, the plurality of pads 260 can also be coupled to a respective one of the floor 212 or a top plate 219. In at least one example, the plurality of pads 260 can be substantially perpendicular to the floor 212.

Figure 5:
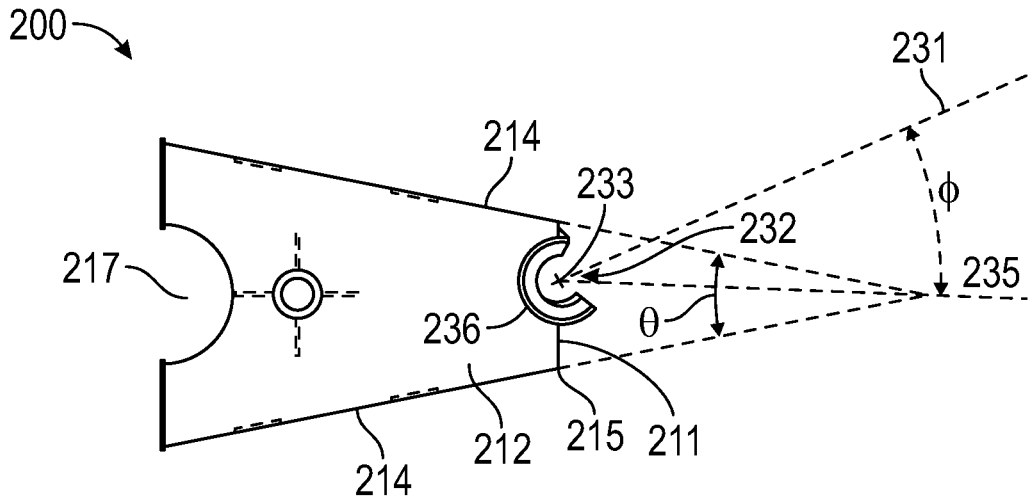
FIG. 5 illustrates a bottom view of an example of a rigid riser adapter.

FIG. 5 illustrates a bottom view of an example of a rigid riser adapter 200. As illustrated in FIG. 5, the plurality of sides 214 have ends 215 that extend past at least a portion of the rigid riser receptacle 230, so that this receptacle is securely welded beyond the centerline of mean load direction 231. In at least one example, the rigid riser receptacle 230 can be coupled to the plurality of sides 214 and floor 212. In at least one example, the rigid riser receptacle 230 can be substantially cylindrical with a slot 232 being formed along a length 234 of the rigid riser receptacle 230. Additionally, the receptacle support structure 210 can include an end plate 211 that is coupled to the plurality of sides 214 and floor 212. In at least one example, the floor 212, top plate 219, and/or the end plate 211 form a receptacle recess portion 236 operable to receive at least a portion of the rigid riser receptacle 230. The rigid riser receptacle 230 can be welded to the floor 212, the top plate 219, and/or the end plate 211. The rigid riser receptacle 230 can be angled (illustrated by line 231, which passes through a centreline of the rigid riser receptacle 230) at angle ø with respect to the horizontal direction 235. The horizontal direction as illustrated corresponds substantially to the abeam direction of the vessel when stationary. The angle ø can be between about minus 50 degrees and about 50 degrees in relation to the horizontal direction 235. The actual value of angle ø depends upon the location of the wells and the subsea pipelines, relative to the vessel's moored position, that have been installed on the sea floor.

As further illustrated in FIG. 5, the plurality of sides 214 are angled such that an angle θ is formed between the plurality of sides 214. The angle θ can be less than ninety degrees and greater than zero degrees. The angle θ allows for transfer of stress in the receptacle support structure 210. In at least one example the angle θ can be between five degrees and thirty-five degrees.

FIGS. 6-11 illustrate a diagrammatic view of a rigid riser adapter 200 during an installation on a lower riser balcony 120 of a vessel 100. The above described rigid riser adapter 200 can be fabricated from steel plate and pipe, and the rigid riser receptacle 230 can be cast, forged, and/or fabricated. The rigid riser end-joint can be installed into the rigid riser receptacle 230. The receptacle support structure 210 is designed and constructed to hold the rigid riser receptacle 230 at required vertical and azimuthal departure angles for a particular riser. Additionally, the receptacle support structure 210 can be configured to hold the rigid riser at the required horizontal distance from the vessel hull. The adapter tube 220 can have a diameter/width that is large enough to provide the required stiffness and strength to support the dynamic moments imposed by the riser. Additionally, the diameter/width of the adapter tube 220 can be small enough to pass through the I-tube 122 of the lower riser balcony 120. The pads 260 of the rigid riser adapter 200 can be constructed to provide a way to distribute the contact force between the rigid riser adapter 200 and the vessel 100 over a larger area, thereby reducing the contact pressure below the structural limits of the vessel 100.

Figure 6:
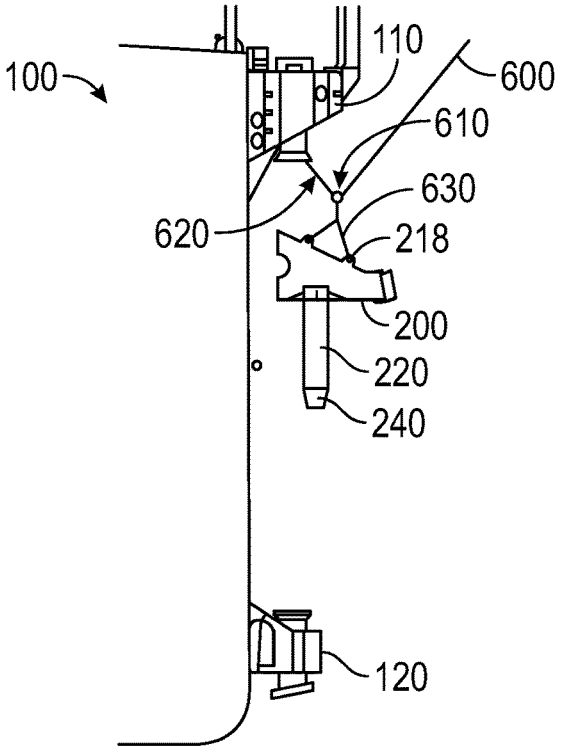
FIGS. 6-11 illustrate a diagrammatic view of a rigid riser adapter being installed on a lower riser balcony.

FIG. 6 illustrates a handover of the rigid riser adapter 200 from a cable 600 that is connected to a crane, winch, or chain jack on a heavy-lift installation or service vessel, at a tri-plate 610 to cable 620 that is connected to an onboard winch and sheave system, crane, or chain-jack on the production vessel. As illustrated, the rigid riser adapter 200 is coupled to cable 600 by a harness 630 that is coupled to the plurality tabs 218 of the rigid riser adapter 200. The vessel winch cable 620 positions the adapter tube 220 and insertion tube 240 between the upper riser balcony 110 and a lower riser balcony 120.

Figure 7:
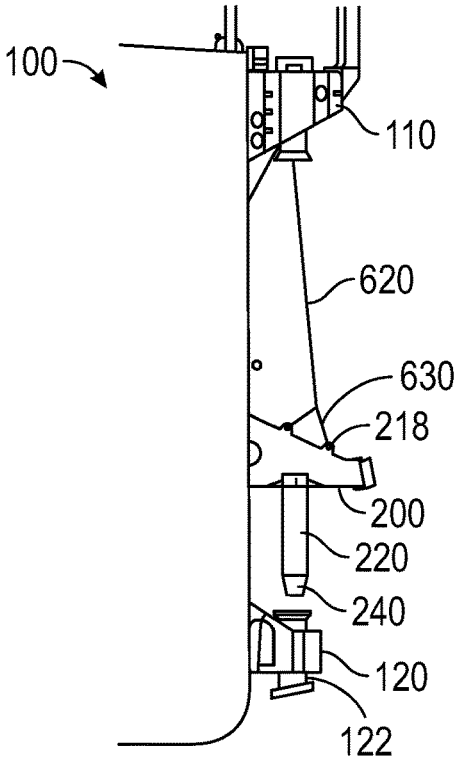

FIG. 7 illustrates positioning of the rigid riser adapter 200 over an opening in lower riser balcony 120 and respective I-tube 122. The rigid riser adapter 200 is suspended by cable 620 that is coupled to the rigid riser adapter 200 by the harness 630 that is coupled to the plurality of tabs 218. The cable 620 positions the adapter tube 220 and insertion tube 240 between the upper riser balcony 110 and just above an opening of the I-tube 122 of the lower riser balcony 120. The opening of the I-tube 122 goes through the lower riser balcony 120.

Figure 8:
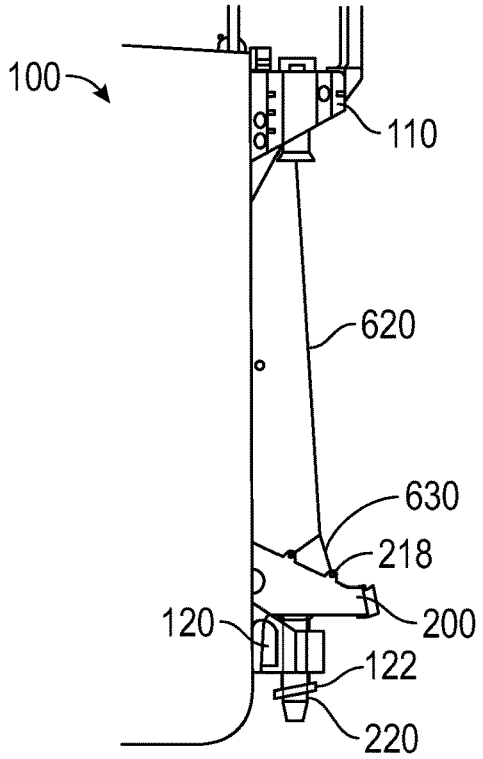

FIG. 8 illustrates positioning of the rigid riser adapter 200 such that the adapter tube 220 passes through the I-tube 122 of the lower riser balcony 120. The cable 620 holds the rigid riser adapter 200 in place and is coupled to the rigid riser adapter 200 by the harness 630 that is coupled to the plurality of tabs 218.

Figure 9:
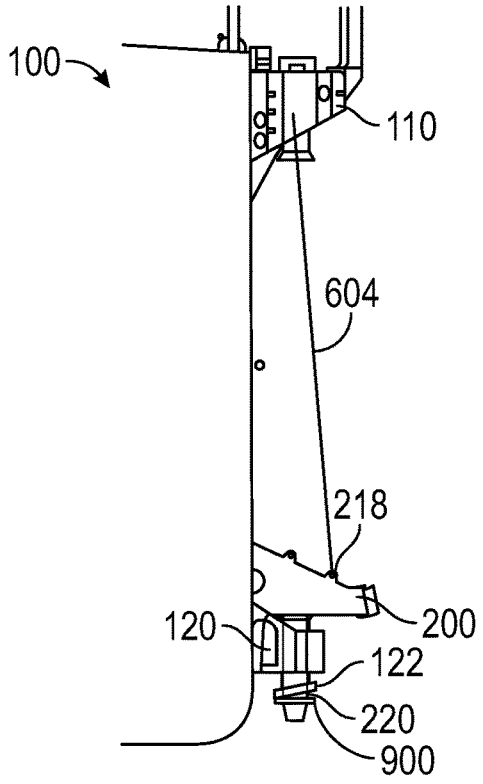

FIG. 9 illustrates inserting a locking bar 900 through the adapter tube 220. The locking bar 900 is configured to abut the I-tube 122 to restrict movement of the adapter tube 220, thereby restraining the rigid riser adapter 200. The locking bar 900 can come in a variety of different types of mechanisms. In one example, the locking bar 900 can be a clamp that is installed around 220 to prevent it from passing upward through the I-tube 122. In one example, the clamp can be a two-piece circular clamp that can be fastened about the adapter tube 220. In the example of a two-piece circular clamp, the adapter tube 220 can include a circumferential groove that corresponds to the installation location of the clamp. In another example, the locking bar 900 can be a bar that can be inserted into a passage through the adapter tube 220. The bar can be substantially circular in cross-section with the passage being substantially circular. In at least one example, the cross-section can be arranged to provide a passage that can be such that a friction fit is established further as the bar is slide into the passage. For example, either the passage or the bar can be configured to establish the friction fit. In yet another example, the locking bar 900 can be a toggle bar that is pre-assembled in a vertical direction within the adapter tube 220. The toggle bar can be flipped down to be in a horizontal orientation, thereby interfering with upward movement of the adapter tube with respect to the I-tube 122. A tension support members 604 is attached to the upper riser balcony 110 of the vessel 100. The support members 604 is attached to the rigid riser adapter 200 by way of a plurality of tabs 218, or to other suitably designed attachment points on the rigid riser adapter. The support members 604 are pre-tensioned until the locking bar 900 is tight against the lower I-tube 122. In the installed configuration as illustrated in FIG. 9, the compressive contact between the pads of the rigid riser adapter 200 and the hull of the vessel, the locking bar 900 and the lower end of the lower riser balcony I-tube 122, and the tensile contact with the upper riser balcony 110 provide three-dimensional restraint of the rigid riser adapter 200 against hydrodynamic forces and the static and dynamic forces and moments that will be imposed by an installed rigid riser.

Figure 10:
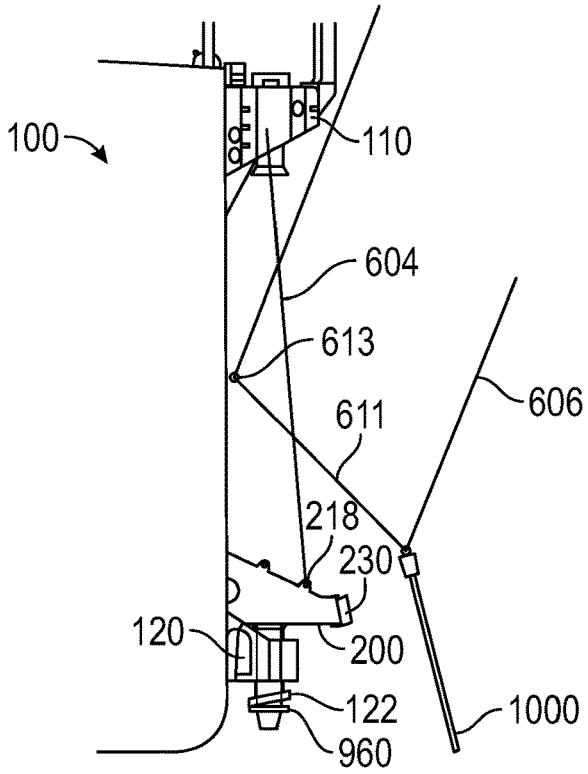

FIG. 10 illustrates a rigid riser 1000 being moved into place via a lifting vessel tension line 606 to vessel pull-in winch line 611 that is routed behind sheave 613 that is temporarily attached to the vessel 100.

Figure 11:
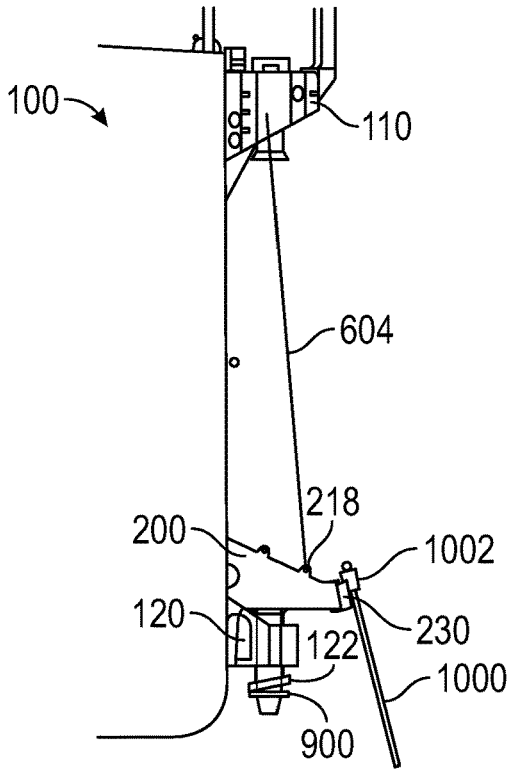

FIG. 11 illustrates a rigid riser 1000 installed in rigid riser receptacle 230. The end joint 1002 of the rigid riser 1000 is held in place by the rigid riser receptacle 230. In this installed configuration, the rigid riser 1000 transfers the full riser tension to the rigid riser receptacle 230 and fully constrains the rigid riser adapter 200 from movement. Forces are transferred from the rigid riser 1000 to the rigid riser adapter 200, which transfers the forces through the adapter tube. The adapter tube transfers forces to the I-tube 122 of the lower riser balcony 120. Member or members 608 remain in place between the rigid riser adapter 200 and the upper riser balcony 110 of the vessel. The member or members 608 are coupled at least one of the tabs 218 or to other suitably designed attachment points on the rigid riser adapter 200, providing transfer of tensile loads to the upper riser balcony 110. The angular orientation of member or members 608 can be other than vertical, with the upper attachment point closer to the hull than the lower attachment point to rigid riser adapter 200, thus ensuring a positive pre-load of rigid riser adapter 200 against the hull.

Figure 12:
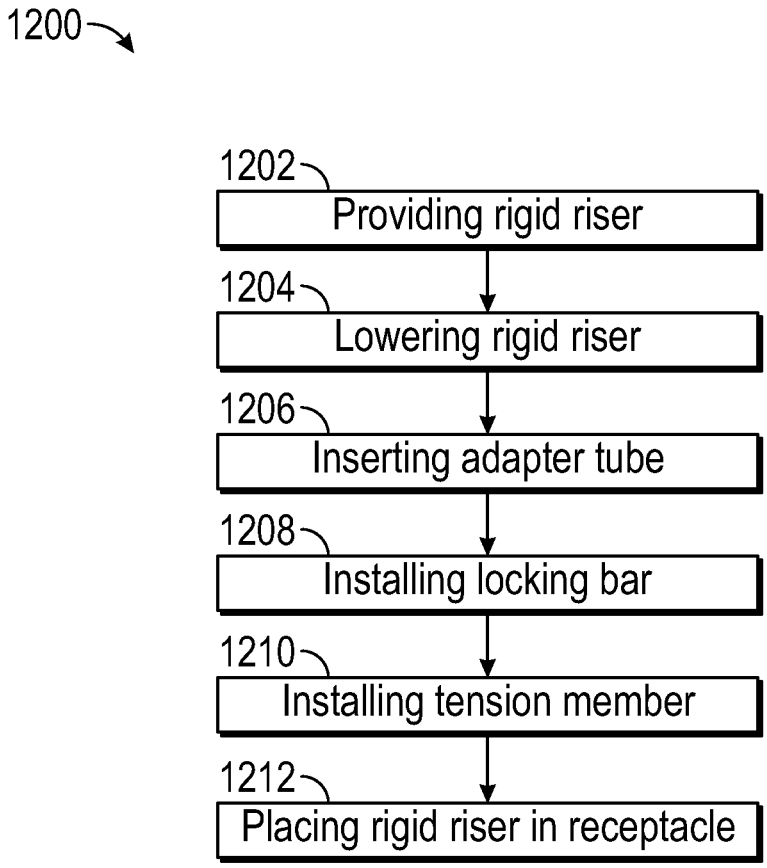
FIG. 12 illustrates an example method of retrofitting a vessel designed for non-rigid risers to accommodate rigid risers.

FIG. 12 illustrates an example method of retroffiting a vessel designed for non-rigid risers to accommodate rigid risers. Referring to FIG. 12, a flowchart is presented in accordance with an example embodiment. The method 1200 is provided by way of example, as there are a variety of ways to carry out the method. The method 1200 described below can be carried out using the configurations illustrated in FIGS. 1-11, for example, and various elements of these figures are referenced in explaining example method 1200. Each block shown in FIG. 12 represents one or more processes, methods or subroutines, carried out in the example method 1200. Furthermore, the illustrated order of blocks is illustrative only and the order of the blocks can change according to the present disclosure. Additional blocks may be added or fewer blocks may be utilized, without departing from this disclosure. The example method 1200 can begin at block 1202.

At block 1202, the method includes providing a rigid riser adapter comprising: an adapter tube operable to be inserted through a lower riser balcony, a receptacle support structure coupled to the adapter tube, a rigid riser receptacle coupled to the receptacle support structure, wherein the rigid riser receptacle is angled between ten degrees and fifteen degrees. (See also FIG. 6 above).

At block 1204, the method includes lowering the rigid riser adapter from an upper riser balcony. (See also FIG. 7 above).

At block 1206, the method includes inserting the adapter tube into a lower riser balcony I-tube. (See also FIG. 8 above).

At block 1208, the method includes installing a locking bar through the adapter tube. (See also FIG. 9 above).

At block 1210, the method includes installing a tension member or members between upper riser balcony and the rigid riser adaptor. Optionally, the tension member or members may be pre-tensioned by means of turnbuckles or alternative tensioning device. As an alternative, the vertical location of the locking device on the adapter tube can provide for a small vertical gap between the rigid riser adapter and the upper surface of the lower riser balcony, providing for the pre-loading of the system to occur upon installation of the rigid riser to the rigid riser receptacle.

At block 1212, the method includes placing a rigid riser in the rigid riser receptacle. (See also FIGS. 10-11 above).

Numerous examples are provided herein to enhance understanding of the present disclosure. A specific set of statements are provided as follows.

Statement 1: A rigid riser adapter operable to be at least partially installed into a lower riser balcony is disclosed, the rigid riser adapter comprising: a receptacle support structure; an adapter tube extending from the receptacle support structure substantially along a vertical direction, the adapter tube operable to be inserted through a lower riser balcony; and a rigid riser receptacle coupled to the receptacle support structure, wherein the rigid riser receptacle is angled between six degrees and twenty degrees in relation to the vertical direction.

Statement 2: A rigid riser adapter is disclosed according to Statement 1, wherein the adapter tube has a distal end that is coupled to a frustoconically shaped insertion tube, wherein the distal end is away from the receptacle support structure.

Statement 3: A rigid riser adapter is disclosed according to Statements 1 or 2, wherein the adapter tube is substantially cylindrical.

Statement 4: A rigid riser adapter is disclosed according to any of preceding Statements 1-3, wherein the receptacle support structure comprises a floor through which the adapter tube extends.

Statement 5: A rigid riser adapter is disclosed according to Statement 4, further comprising at least one attachment plate coupled to the floor and the adapter tube.

Statement 6: A rigid riser adapter is disclosed according to Statement 5, wherein the at least one attachment plate comprises a plurality of attachment plates.

Statement 7: A rigid riser adapter is disclosed according to Statement 6, wherein the plurality of adapter plates are substantially triangular shaped.

Statement 8: A rigid riser adapter is disclosed according to any of preceding Statements 1-7, wherein the receptacle support structure comprises a floor and the adapter tube extends from the floor; and a plurality of sides extending from the floor.

Statement 9: A rigid riser adapter is disclosed according to Statement 8, wherein the plurality of sides are substantially perpendicular to the floor.

Statement 10: A rigid riser adapter is disclosed according to Statements 8 or 9, further comprising a plurality of pads that are coupled to one of the plurality of sides.

Statement 11: A rigid riser adapter is disclosed according to Statement 10, wherein the plurality of pads are substantially perpendicular to the floor.

Statement 12: A rigid riser adapter is disclosed according to Statements 10 or 11, wherein each of the plurality of sides form a substantially semi-circular cutout between two of the plurality of pads.

Statement 13: A rigid riser adapter is disclosed according to any of preceding Statements 8-12, wherein a plurality of tabs are formed on each of the plurality of sides.

Statement 14: A rigid riser adapter is disclosed according to any of preceding Statements 8-13, wherein the rigid riser receptacle is coupled to the plurality of sides and floor.

Statement 15: A rigid riser adapter is disclosed according to Statement 14, wherein the rigid riser receptacle is substantially cylindrical with a slot being formed along a length of the rigid riser receptacle.

Statement 16: A rigid riser adapter is disclosed according to Statements 14 or 15, further comprising an end plate coupled to the plurality of sides and floor.

Statement 17: A rigid riser adapter is disclosed according to any of preceding Statements 14-16, wherein the plurality of sides have ends that extend past at least a portion of the rigid riser receptacle.

Statement 18: A rigid riser adapter is disclosed according to any of preceding Statements 14-17, further comprising a top plate coupled to the plurality of sides and being substantially opposite the floor.

Statement 19: A rigid riser adapter is disclosed according to any of preceding Statements 8-18, further comprising a top plate coupled to the plurality of sides and being substantially opposite the floor, wherein the floor and the top plate form a receptacle recess portion operable to receive at least a portion of the rigid riser receptacle.

Statement 20: A rigid riser adapter is disclosed according to any of preceding Statements 8-19, wherein the plurality of sides are angled such that an angle formed between the plurality of sides is less than ninety degrees and greater than zero degrees.

Statement 21: A rigid riser adapter is disclosed according to Statement 20, wherein the angle is less than thirty degrees and greater than ten degrees.

Statement 22: A method of retrofitting a vessel designed for non-rigid risers to accommodate rigid risers is disclosed, the method comprising: providing a rigid riser adapter comprising: an adapter tube operable to be inserted through a lower riser balcony, a receptacle support structure coupled to the adapter tube, a rigid riser receptacle coupled to the receptacle support structure, wherein the rigid riser receptacle is angled between ten degrees and fifteen degrees; lowering the rigid riser adapter from an upper riser balcony; inserting the adapter tube into a lower riser balcony I-tube; installing a locking bar through the adapter tube; installing at least one tension-conducting member between the upper porch and the rigid riser adapter; and placing a rigid riser in the rigid riser receptacle.

Statement 23: A method is disclosed according to Statement 22, further comprising pre-tensioning the at least one tension-conducting member.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A rigid riser adapter operable to be at least partially installed into a lower riser balcony, the rigid riser adapter comprising:

a receptacle support structure;

an adapter tube extending from the receptacle support structure substantially along a vertical direction, the adapter tube operable to be inserted through a lower riser balcony; and a rigid riser receptacle coupled to the receptacle support structure, wherein the rigid riser receptacle is angled between six degrees and twenty degrees in relation to the vertical direction.

2. The rigid riser adapter as recited in claim 1, wherein the adapter tube has a distal end that is coupled to a frustoconically shaped insertion tube, wherein the distal end is away from the receptacle support structure.

3. The rigid riser adapter as recited in claim 1, wherein the adapter tube is substantially cylindrical.

4. The rigid riser adapter as recited in claim 1, wherein the receptacle support structure comprises a floor through which the adapter tube extends.

5. The rigid riser adapter as recited in claim 4, further comprising at least one attachment plate coupled to the floor and the adapter tube.

6. The rigid riser adapter as recited in claim 5, wherein the at least one attachment plate comprises a plurality of attachment plates.

7. The rigid riser adapter as recited in claim 6, wherein the plurality of attachment plates are substantially triangular shaped.

8. The rigid riser adapter as recited in claim 1, wherein the receptacle support structure comprises a floor and the adapter tube extends from the floor; and a plurality of sides extending from the floor.

9. The rigid riser adapter as recited in claim 8, wherein the plurality of sides are substantially perpendicular to the floor.

10. The rigid riser adapter as recited in claim 8, further comprising a plurality of pads that are coupled to one of the plurality of sides.

11. The rigid riser adapter as recited in claim 10, wherein the plurality of pads are substantially perpendicular to the floor.

12. The rigid riser adapter as recited in claim 10, wherein each of the plurality of sides form a substantially semicircular cutout between two of the plurality of pads.

13. The rigid riser adapter as recited in claim 8, wherein a plurality of tabs are formed on each of the plurality of sides.

14. The rigid riser adapter as recited in claim 8, wherein the rigid riser receptacle is coupled to the plurality of sides and the floor.

15. The rigid riser adapter as recited in claim 14, wherein the rigid riser receptacle is substantially cylindrical with a slot being formed along a length of the rigid riser receptacle.

16. The rigid riser adapter as recited in claim 14, further comprising an end plate coupled to the plurality of sides and the floor.

17. The rigid riser adapter as recited in claim 14, wherein the plurality of sides have ends that extend past at least a portion of the rigid riser receptacle.

18. The rigid riser adapter as recited in claim 14, further comprising a top plate coupled to the plurality of sides and being substantially opposite the floor.

19. The rigid riser adapter as recited in claim 8, further comprising a top plate coupled to the plurality of sides and being substantially opposite the floor, wherein the floor and the top plate form a receptacle recess portion operable to receive at least a portion of the rigid riser receptacle.

20. The rigid riser adapter as recited in claim 8, wherein the plurality of sides are angled such that an angle formed between the plurality of sides is less than ninety degrees and greater than zero degrees.

21. The rigid riser adapter as recited in claim 20, wherein the angle is less than thirty degrees and greater than ten degrees.

22. A method of retrofitting a vessel designed for non-rigid risers to accommodate rigid risers, the method comprising:

providing a rigid riser adapter comprising: an adapter tube operable to be inserted through a lower riser balcony, a receptacle support structure coupled to the adapter tube, a rigid riser receptacle coupled to the receptacle support structure, wherein the rigid riser receptacle is angled between ten degrees and fifteen degrees;

lowering the rigid riser adapter from an upper riser balcony;

inserting the adapter tube into a lower riser balcony I-tube;

installing a locking bar through the adapter tube;

installing at least one tension-conducting member between an upper riser balcony and the rigid riser adapter;

placing a rigid riser in the rigid riser receptacle.

23. The method of claim 22, further comprising pre-tensioning the at least one tension-conducting member.

* * * * *